US007137756B1

(12) United States Patent
Jones

(10) Patent No.: US 7,137,756 B1
(45) Date of Patent: Nov. 21, 2006

(54) FLUID-TIGHT BELL-AND-SPIGOT-JOINT FOR BOX CULVERTS

(75) Inventor: William D. Jones, Warrington, PA (US)

(73) Assignee: Hail Mary Rubber Co., Inc., Warminster, PA (US)

( * ) Notice: Subject to any disclaimer, the term of this patent is extended or adjusted under 35 U.S.C. 154(b) by 0 days.

(21) Appl. No.: 11/261,224

(22) Filed: Oct. 27, 2005

(51) Int. Cl.
*E01F 5/00* (2006.01)

(52) U.S. Cl. ..... 405/126; 405/124

(58) Field of Classification Search ..... 405/124–126
See application file for complete search history.

(56) References Cited

U.S. PATENT DOCUMENTS

| | | | | | |
|---|---|---|---|---|---|
| 4,040,651 | A * | 8/1977 | LaBranche | 285/113 |
| 4,333,662 | A | 6/1982 | Jones | 277/207 A |
| 4,342,475 | A * | 8/1982 | Moran | 285/152.1 |
| 4,443,019 | A * | 4/1984 | Ishido et al. | 277/652 |
| 4,449,713 | A * | 5/1984 | Ishido et al. | 277/312 |
| 4,664,421 | A | 5/1987 | Jones | 285/110 |
| 4,871,180 | A * | 10/1989 | Preisendorfer | 277/625 |
| 5,040,921 | A * | 8/1991 | Torok | 405/150.1 |
| 5,169,161 | A | 12/1992 | Jones | 277/207 A |
| 5,482,403 | A | 1/1996 | Jones | 405/157 |
| 5,525,007 | A | 6/1996 | Jones et al. | 405/52 |
| 5,599,028 | A * | 2/1997 | Neumann et al. | 277/605 |
| 5,687,997 | A * | 11/1997 | Beacom | 285/94 |
| 5,979,908 | A | 11/1999 | Jones | 277/604 |
| 6,014,849 | A * | 1/2000 | Yonemura | 52/586.1 |
| 6,052,960 | A * | 4/2000 | Yonemura | 52/393 |
| 6,164,618 | A * | 12/2000 | Yonemura | 249/35 |
| 6,457,725 | B1 | 10/2002 | Jones | 277/606 |
| 6,827,326 | B1 * | 12/2004 | Giri | 249/165 |

OTHER PUBLICATIONS

Hail Mary Rubber Co., Inc., "*Rubberman-BW*", 4 page brochure, (date unknown).

* cited by examiner

*Primary Examiner*—Frederick L. Lagman
(74) *Attorney, Agent, or Firm*—Howson and Howson

(57) ABSTRACT

A box culvert and gasket assembly is provided that enables fluid-tight bell-and spigot joints to be formed between abutting ends of box culverts. The joints according to the assembly of the present invention can remain fluid-tight up to at least 13 psi of water pressure. The gasket is preferably a one-piece, endless rubber gasket that is applied over the end of a spigot that is rectangular in end elevation. The corners of the rectangular spigot are rounded to enable the gasket to extend continuously over the corner without the need for 45° cuts and splices. Preferably, the gasket is made from a single elongate gasket piece that is cut to size and that has ends that are bonded together via a butt vulcanization technique. A storm drain and sewer assembly and a method of forming a fluid-tight bell-and spigot joint are also provided.

14 Claims, 2 Drawing Sheets

FLUID-TIGHT BELL-AND-SPIGOT-JOINT FOR BOX CULVERTS

BACKGROUND OF THE INVENTION

The present invention relates to a method of creating a storm drain and/or sewer with a plurality of precast concrete box culverts. In addition, the present invention relates to a box culvert and gasket assembly capable of use in forming fluid-tight bell-and-spigot-joints.

Precast concrete box culverts are used to form relatively-large underground storm drains and sewers. A plurality of separately manufactured box culverts can be coupled together end-to-end at a job site to form a desired run of a storm drain or sewer. As noted by the term "box", box culverts are typically rectangular and define a relatively-large substantially-rectangular passageway therethrough that extends between opposite end faces of the box culvert. For example, the end face of a box culvert may have a 12.5 foot span by a 4 foot rise, or may be of other rectangular dimensions such as a 5 foot span by a 3 foot rise. Each box culvert and its defined passage may have a length of about several feet. The precise alignment and proper coupling of box culverts at a job site is difficult due to the bulky size and substantial weight of the box culverts. Accordingly, progress of the construction of a storm drain or sewer can be limited to coupling as few as about three box culverts per day.

One end face of a precast concrete box culvert typically has a spigot that is substantially rectangular in end elevation. The spigot has four generally straight sides interconnected by four right angle corners. The opposite end face of the box culvert has a complementary-shaped bell for receiving the spigot so that adjacent box culverts can be coupled together to form a bell-and-spigot joint therebetween. Gaskets or the like can be compressed within the joint to provide a fluid-tight seal. Typically, four separate rubber gaskets are mounted on the spigot, one on each side of the rectangular spigot. The ends of the rubber gaskets are cut at a 45° angle so that they abut with an end of an adjacent gasket at the right angle corner. Seals with such gaskets have met certain industry standards which require a seal to be leakproof only up to about 6 psi.

U.S. Pat. No. 6,827,326 B2 issued to Giri provides an example of a precast concrete box culvert capable of forming a bell-and-spigot-joint. Also see U.S. Pat. No. 5,169,161 issued to Jones and U.S. Pat. Nos. 5,482,403 and 5,525,007 issued to Jones et al. which disclose bell-and-spigot-joints in general and gaskets for cylindrical pipes.

While the box culverts, gaskets, and joints disclosed above and in the above referenced patents may function in an acceptable manner, there is a need for an improved box culvert and gasket assembly, an improved watertight storm drain and/or sewer made from box culverts, and an improved method of forming a fluid-tight seal between box culverts. Preferably, the assembly should provide a seal that can compensate for any misalignment between adjacent box culverts, should enable ready coupling of box culverts thereby reducing the construction time of storm drains and sewers, and should create a seal capable of remaining fluid-tight up to at least 13 psi of water pressure.

BRIEF SUMMARY OF THE INVENTION

According to one aspect of the present invention, a box culvert and gasket assembly is provided. The assembly includes a precast concrete box culvert that defines a longitudinally-extending passage for fluid flow between openings formed in opposite end faces of the box culvert. A spigot for use in forming a bell-and-spigot-joint with a like box culvert extends longitudinally from one of the end faces about one of the openings. In end elevation, the spigot is substantially rectangular and has four rounded corners each formed at a predetermined radius of curvature. A one piece gasket is secured to an outer peripheral surface of the spigot and encircles the spigot. The gasket is continuous without ends and extends smoothly without interruptions over the rounded corners of the spigot.

According to another aspect of the present invention, a watertight storm drain and/or sewer assembly is provided. The assembly is constructed from a plurality of the above referenced precast concrete box culverts joined end-to-end to form a desired run of the storm drain and/or sewer. Each adjacent pair of box culverts is coupled together to form a bell-and-spigot-joint in which the gasket is compressed and provides a seal that is fluid-tight up to at least 13 psi of water pressure.

According to a further aspect of the present invention, a method of forming a compression seal within a bell-and-spigot-joint of a coupled pair of box culverts is provided. The method includes the steps of providing a plurality of the above referenced precast concrete box culverts and of installing a continuous and endless one-piece rubber gasket onto the outer peripheral surface of each spigot such that the gaskets encircle the spigots. Thereafter, a pair of the box culverts are coupled together to form a bell-and-spigot-joint therebetween to compress the gasket and form a fluid-tight seal.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 1:
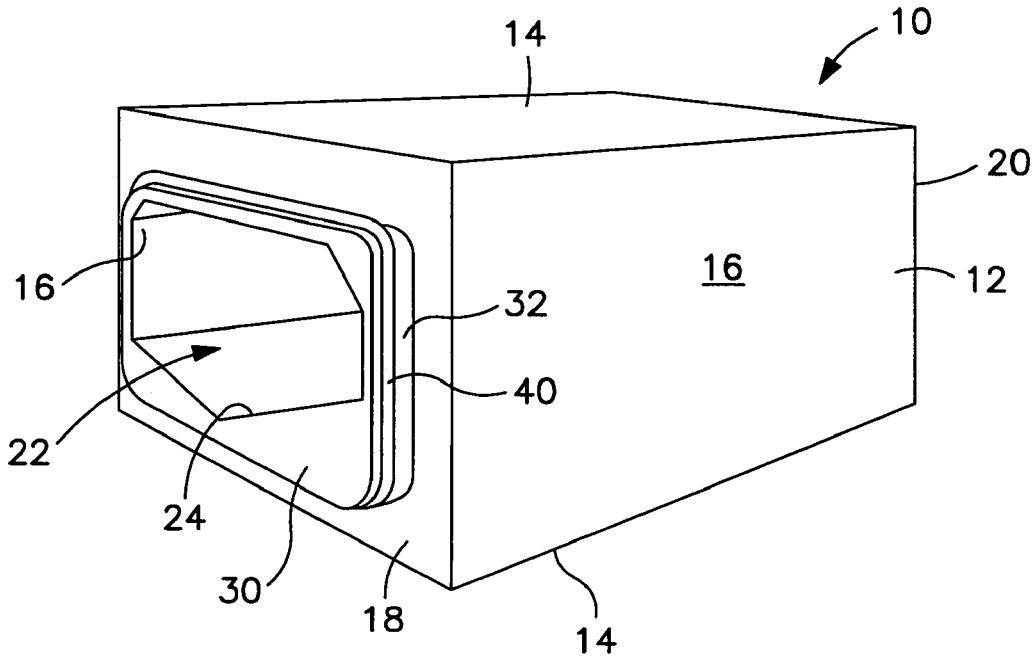
FIG. 1 is a perspective view of a box culvert according to the present invention.

FIG. 1 illustrates a box culvert and gasket assembly 10 according to the present invention. The box culvert 12 is precast of concrete and has longitudinally-extending upper and lower walls 14, a pair of longitudinally-extending side walls 16, and a pair of transversely-extending end faces 18 and 20 that together form an overall substantially rectangular shape. A relatively-large passageway 22 extends along a longitudinal axis "L" through the box culvert 12 continuously between the end faces 18 and 20. The passageway 22 forms a relatively-large opening 24 in each of the end faces, 18 and 20. Accordingly, when a plurality of like box culverts 12 are joined end-to-end, the assembly defines an elongate run of a storm drain and/or sewer. By way of example, a typical size of a box culvert may be 12.5 feet in span by 4 feet in rise by several feet in length. Another common size is 5 feet in span by 3 feet in rise by several feet in length. Of course, box culverts can be cast in any size desired.

Figure 3:
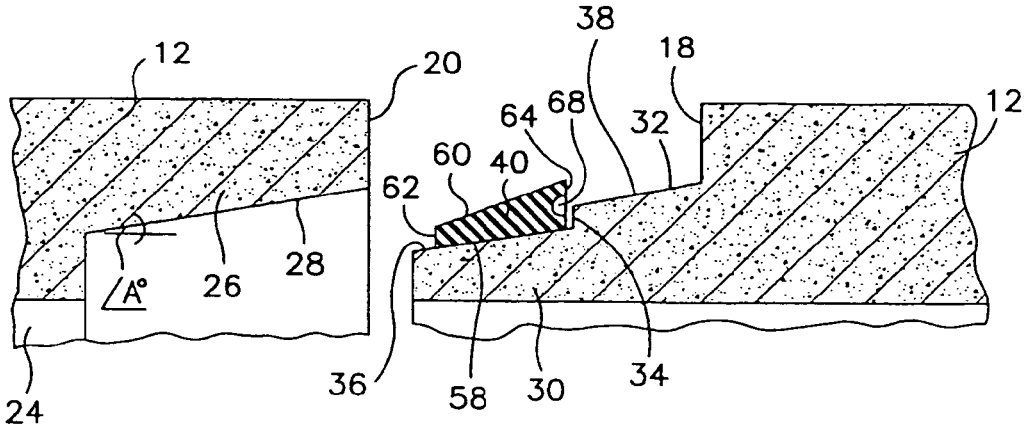
FIG. 3 is a cross-sectional view of a bell end of one box culvert and a spigot end of another box culvert in an uncoupled position.

An end of the box culvert 12 adjacent end face 20 is provided with a bell 26. As best illustrated in FIG. 3, the bell 26 has an inner peripheral wall 28 that tapers outwardly in transverse cross-section toward the end face 20. Preferably, the wall 28 has a straight taper that extends at an angle "A" of about 5° to about 10° relative to the longitudinal axis "L" of the box culvert 12. The bell 26 extends around the opening 24 of the passageway 22 and is shaped and sized to receive the opposite end of a like box culvert.

Figure 4:
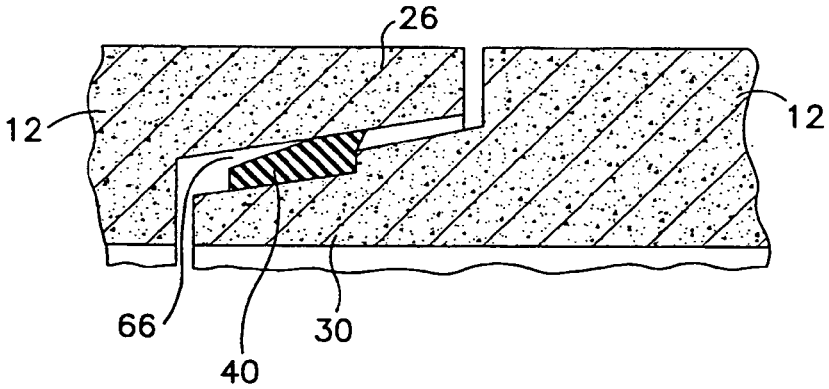
FIG. 4 is a cross-sectional view of the bell and spigot of FIG. 3 in a coupled position.
Figure 5:
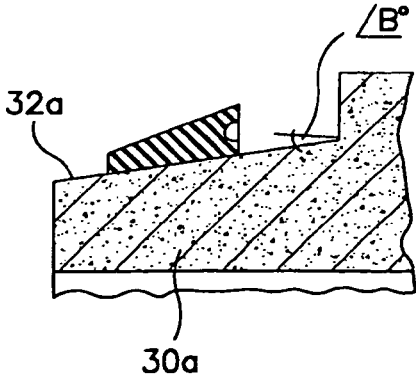
FIG. 5 is a cross sectional view of an alternate spigot having a straight taper.

The end of the box culvert 12 adjacent end face 18 has a spigot 30 that extends in a longitudinal direction therefrom and encircles the opening 24 of the passageway 22. The spigot 30 is receivable within the bell 26 of a like box culvert to form a bell-and-spigot-joint therewith. For example, see FIG. 4. The spigot 30 has an outer peripheral surface 32 that tapers inwardly in transverse cross-section from the end face 18. The taper of surface 32 is preferably at an angle "B" of about 5° to about 10° relative to the longitudinal axis "L" of the box culvert 12. The spigot 30 illustrated in FIGS. 3 and 4 have a so-called single off-set tapered surface 32 having a stepped juncture 34 between first and second sections, 36 and 38, of the surface 32. This enables the formation of a single offset or double-groove joint as illustrated in FIG. 4. Alternatively, the surface 32*a* of spigot 30*a* can have a straight taper as illustrated in FIG. 5 to enable the formation of a simple or straight tongue-and-groove joint.

Figure 2:
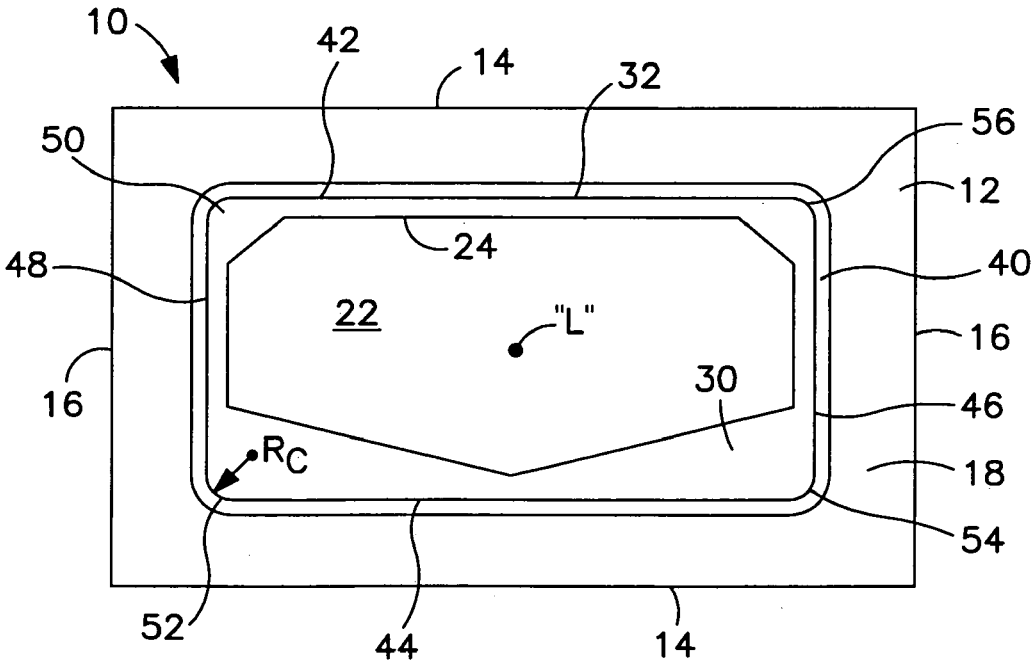
FIG. 2 is an elevational view of a spigot end of the box culvert of FIG. 1.

A gasket 40 is secured on the outer peripheral surface 32 of the spigot 30 such that the gasket 40 completely encircles the spigot 30. As best shown in FIG. 3, the gasket 40 is preferably located on the first section 36 of the surface 32 adjacent the step 34. Thus, the vertical wall of the step 34 abuts the gasket 40 and functions as a backstop to the gasket 40. The path, or footprint, about which the gasket 40 follows around the spigot 30 is generally rectangular, for instance, as best seen in FIG. 2. This is because the outer peripheral surface 32 of the spigot 30 is substantially rectangular when viewed in end elevation. The surface 32 according to the present invention has relatively elongate and straight upper, lower, right, and left sections 42, 44, 46 and 48 interconnected by four corners 50, 52, 54 and 56. Each corner 50, 52, 54 and 56 is rounded and is formed at a predetermined radius of curvature $R_c$ of about 6 to 10 inches. The rounded corners 50, 52, 54 and 56 enable the gasket 40 to extend continuously and smoothly around the corners 50, 52, 54 and 56 without interruption or the need for 45° angle cuts and joints.

The gasket 40 is made from a single elongate piece of flexible gasket material that is cut to a predetermined desired length. The opposite ends of the elongate gasket material are bonded together via a butt vulcanization process. Thus, the gasket 40, as applied to the spigot 30, is a one piece, continuous, endless gasket 40 that fits about the outer peripheral surface 32 of the spigot 30. Preferably, the gasket 40 is made of solid vulcanized rubber having a durometer of about 40 to about 50 and an elasticity, or stretch, of about 4% to 8%. More preferably, the vulcanized rubber gasket 38 has a durometer of 40 and an elasticity of 6%.

The gasket 40 is preferably wedge-shaped in transverse cross-section as best illustrated in FIG. 3. The wedge shape is provided by a solid gasket 40 having an inner peripheral wall 58, an outer peripheral wall 60 that is sloped relative to the inner peripheral wall 58, a front wall 62, and a rear wall 64 that extends to a greater height then the front wall 62. As best illustrated in FIG. 4, the wedge shape permits the bell 26 of an adjacent box culvert to extend beyond the entrance slope 66 of the gasket 40 before compression of the gasket 40 is initiated. Preferably, the rear wall 64 of the gasket 40 is notched with an inset groove 68 that extends continuously and circumferentially on the gasket 40 completely about the spigot 30. This provides the gasket 40 with mechanical softness enabling the gasket 40 to have a sufficient thickness at a point of maximum compression so that it compresses sufficiently to from a fluid-tight seal but does not create an over-packing condition in which difficulty would be experienced in coupling the joint.

A method according to the present invention of forming a fluid-tight seal between adjacent precast concrete box culverts along the run of storm drain or sewer is as follows. A plurality of the above referenced precast concrete box culverts 12 having spigots 30 with outer peripheral surfaces 32 that are substantially rectangular in end elevation are delivered to a job site. The corners 50, 52, 54 and 56 of the substantially rectangular spigots 30 are formed at a predetermined radius of curvature $R_c$ and are rounded instead of being sharp right angle corners. Before or after delivery, a continuous and endless one-piece rubber gasket 40 is installed on the outer peripheral surface 32 of the spigot 30 on each box culvert to encircle the spigot 30. Preferably, measurements are taken with respect to the length of the path about the outer peripheral surface 32 of the spigot 30, and a single elongate piece of a rubber gasket is cut to an appropriate size. Thereafter, the ends of the gasket are secured together by butt vulcanization techniques before being applied to the spigot 30.

The endless rubber gasket 40 is cemented with a glue, cement or adhesive to the outer peripheral surface 32 of the spigot 30. Preferably, a continuous layer of cement is applied along one of the elongate sections 42, 44, 46 or 48 of the surface 32 and a corresponding section of the gasket 40 is clamped thereto with boards and C-clamps. Thereafter, a continuous layer of cement is applied along another one of the elongate sections 42, 44, 46 or 48 of the surface 32 and a corresponding confronting section of the gasket 40 is clamped thereto. This process is continued until the entire gasket 40 is cemented to the spigot 30. After the cement sets, the boards and clamps are removed. This cementing process ensures that the gasket 40 is bonded to the spigot 30 via a substantially continuous layer of cement encircling the spigot thereby reducing the likelihood that the gasket 40 will be forced out of its proper position during a box culvert coupling process. If the gasket 40 is not seated properly within the bell-and-spigot joint, a desired fluid-tight seal will not be formed.

After the gasket 40 is installed on the spigot 30 and before the box culvert is coupled to an adjacent box culvert, the outer peripheral sloped wall 60 of the gasket 40 is applied with a lubricant or grease, such as a hydrocarbon or vegetable based grease. In addition, before a pair of box culverts are drawn together, care must be taken to insure that the box culverts are centered on a common longitudinal axis "L" and are as close to line and grade as possible. Thereafter, the box culverts can be drawn together and coupled. Preferably, a box culvert with a bell end positioned adjacent a spigot end of a stationary pre-installed box culvert is drawn into engagement with the stationary box culvert with the use of a come-along or pipe-puller device. The lubricant ensures that the bell 26 of an adjacent box culvert can travel over the spigot 30 and gasket 40 to form a relatively tight bell-to-spigot joint.

Utilizing the one piece endless gasket 40 and rectangular spigot 30 with rounded corners according to the present invention, a bell-to-spigot-joint that is fluid-tight up to at least 13 psi water pressure can be formed between box culverts. In addition, installation of the one-piece endless gaskets reduces the time required to install the gaskets and permits an increase in the number of box culverts that can be coupled together within a single day by a single crew from about three to about twenty. The box culvert and gasket assembly provides compensation for misalignment and permits fluid-tight storm drains and sewers to be constructed in reduced amount of times.

While preferred assemblies, box culverts, gaskets, storm drains and sewers, and methods have been described in detail, changes may be made without departing from the spirit and scope of the assemblies, box culverts, gaskets, storm drains and sewers, and methods according to the present invention as defined in the appended claims.

The invention claimed is:

1. A box culvert and gasket assembly, comprising:

a precast concrete box culvert defining a longitudinally-extending passage therethrough for fluid flow between openings formed in opposite end faces of said box culvert;

a spigot for use in forming a bell-and-spigot-joint with a like box culvert extending longitudinally from one of said end faces about one of said openings, said spigot being substantially rectangular in end elevation and having rounded corners in end elevation formed at a predetermined radius of curvature, said spigot in end elevation having substantially straight and elongate upper and lower sections each connecting to substantially straight and elongate right and left side sections via said rounded corners, and said radius of curvature of said rounded corners being about 6 to about 10 inches; and a one-piece rubber gasket secured to an outer peripheral surface of said spigot such that said gasket encircles said spigot, said gasket being continuous without ends and extending over said rounded corners, said rubber gasket having approximately 4% to 8% elasticity and a durometer of about 40 to about 50, and said gasket being cemented to said outer peripheral surface of said spigot with a layer of cement that extends substantially continuously about said spigot on said outer peripheral surface of said spigot.

2. An assembly according to claim 1, wherein said gasket is a solid, endless, vulcanized rubber gasket that is wedge-shaped in transverse cross-section.

3. An assembly according to claim 2, wherein said gasket has an inner peripheral wall, an outer peripheral wall which is sloped relative to said inner peripheral wall, a rear wall, and a front wall, and wherein said rear wall is greater in height than said front wall thereby providing said gasket with said wedge-shaped.

4. An assembly according to claim 3, wherein said gasket has a continuous circumferentially-extending groove formed in said rear wall providing mechanical softness to said wedge-shaped gasket.

5. An assembly according to claim 4, wherein said outer peripheral surface of said spigot tapers inwardly at an angle of about 5° to about 10 relative to a longitudinal axis of said culvert as said outer peripheral surface extends outwardly from said end face of said culvert.

6. An assembly according to claim 5, wherein said outer peripheral surface of said spigot has a substantially straight taper for use in forming a simple-joint with a bell end of a like box culvert.

7. An assembly according to claim 5, wherein said outer peripheral surface of said spigot has a single off-set tapered surface on which said gasket is secured for use in forming a double-groove-joint with a bell end of a like box culvert.

8. An assembly according to claim 1, wherein one of said opposite end faces of said box culvert has a bell for forming a bell-and-spigot-joint with a spigot of a like box culvert, whereby, when said bell of one box culvert is mated with said spigot of an adjacent box culvert, said gasket is compressed therebetween creating a seal that is fluid-tight up to at least 13 psi water pressure.

9. A watertight storm drain and/or sewer assembly, comprising:

a plurality of identical precast concrete box culverts joined end-to-end to form a desired run of the assembly;

each box culvert defining a longitudinally-extending passage therethrough for fluid flow between openings formed in opposite end faces of said box culvert;

each box culvert having a spigot extending longitudinally from one of said end faces about said passage, said spigot being substantially rectangular in end elevation and having rounded corners in end elevation formed at a predetermined radius of curvature;

each box culvert having a bell extending longitudinally from an opposite one of said end faces;

each box culvert having a one-piece, solid, endless, vulcanized rubber gasket having an inner peripheral wall cemented to an outer peripheral surface of said spigot such that said gasket encircles said spigot, said gasket being continuous without ends and extending over said rounded corners, said rubber gasket having approximately 6% elasticity and a durometer of about 40, and said gasket having a rear wall, a front wall, and an outer peripheral wall that is sloped relative to said inner peripheral wall, and said rear wall of said gasket being greater in height than said front wall thereby providing said gasket with a wedge-shape in transverse cross-section; and each adjacent pair of box culverts being coupled together to form a bell-and-spigot-joint in which said gasket is compressed and provides a seal that is fluid-tight up to at least 13 psi water pressure.

10. An assembly according to claim 9, wherein said gasket has a continuous circumferentially-extending groove formed in said rear wall providing mechanical softness to said wedge-shaped gasket.

11. An assembly according to claim 10, wherein said outer peripheral surface of said spigot tapers inwardly at an angle of about 5° to about 10° relative to a longitudinal axis of said box culvert, and wherein said bell-and-spigot-joint is a simple-joint or a double-groove joint.

12. A method of forming a compression seal within a bell-and-spigot-joint of a box culvert, comprising the steps of:

providing a plurality of precast concrete box culverts each having an end face with a spigot and an opposite end face with a bell;

obtaining an elongate strip of a rubber gasket having a wedge-shaped transverse cross-section, cutting said elongate strip to a predetermined length, and securing opposite ends of said elongate strip together via a butt vulcanization process to provide an endless rubber gasket;

installing said continuous and endless one-piece rubber gasket onto an outer peripheral surface of said spigot such that said gasket encircles said spigot, said installing step includes applying cement in a substantially continuous layer on said outer peripheral surface of said spigot to encircle said spigot and firmly cement said gasket to said spigot;

coupling a pair of identical box culverts together to form a bell-and-spigot-joint therebetween and thereby compressing said gasket between said bell and spigot to form a fluid-tight seal; and applying a lubricant to an outer surface of said wedge-shaped gasket after said installing step and before said coupling step.

13. A method according to claim 12, wherein said seal is formed such that it is fluid-tight up to at least about 13 psi water pressure.

14. A method according to claim 13, further comprising the step of mechanically softening said gasket by forming a continuous circumferentially-extending groove in a thickest part of said gasket before said installing step.

* * * * *